US009212436B2

(12) United States Patent
Mitsuno

(10) Patent No.: US 9,212,436 B2
(45) Date of Patent: Dec. 15, 2015

(54) METHOD OF EASY PRODUCTION OF NONWOVEN FABRIC HAVING AT LEAST ONE PROJECTION AND AT LEAST ONE RECESS, AND METHOD OF EASY PROCESSING OF NONWOVEN FABRIC

(75) Inventor: Satoshi Mitsuno, Kanonji (JP)

(73) Assignee: UNICHARM CORPORATION, Ehime (JP)

( * ) Notice: Subject to any disclaimer, the term of this patent is extended or adjusted under 35 U.S.C. 154(b) by 421 days.

(21) Appl. No.: 13/640,559

(22) PCT Filed: Apr. 13, 2011

(86) PCT No.: PCT/JP2011/059668

§ 371 (c)(1),
(2), (4) Date: Oct. 11, 2012

(87) PCT Pub. No.: WO2011/129463

PCT Pub. Date: Oct. 20, 2011

(65) Prior Publication Data

US 2013/0137328 A1 May 30, 2013

(30) Foreign Application Priority Data

Apr. 16, 2010 (JP) ..... 2010-095235

(51) Int. Cl.
*D04H 1/495* (2012.01)
*D06C 3/00* (2006.01)
(Continued)

(52) U.S. Cl.
CPC . *D04H 1/50* (2013.01); *D04H 1/44* (2013.01); *D04H 1/49* (2013.01); *D04H 1/495* (2013.01);
(Continued)

(58) Field of Classification Search
CPC ..... D04H 3/11; D04H 1/44; D04H 1/49; D04H 1/495; D04H 1/50; D04H 1/70; D04H 3/02; D06C 3/00; D06C 3/06; D06C 23/00; D06C 29/005
USPC ..... 28/104, 106, 167, 105
See application file for complete search history.

(56) References Cited

U.S. PATENT DOCUMENTS 2,862,251 A * 12/1958 Kalwaites ..... 264/119
3,033,721 A * 5/1962 Kalwaites ..... 442/50
(Continued)

FOREIGN PATENT DOCUMENTS

CN 101541525 A 9/2009
EP 2096201 A1 9/2009
(Continued)

OTHER PUBLICATIONS

International Search report corresponding to PCT/JP2011/059668, dated Jul. 19, 2011.
(Continued)

*Primary Examiner* — Amy Vanatta
(74) *Attorney, Agent, or Firm* — Hauptman Ham, LLP

(57) ABSTRACT

It is an object of the invention to provide a method of easy production of a nonwoven fabric having at least one projection and at least one recess and to a method of easy processing of a nonwoven fabric.

A method of producing a nonwoven fabric having at least one projection and at least one recess, comprising the steps of non-homogeneous stretching a nonwoven fabric so as to form a nonwoven fabric with high-stretch regions and low-stretch regions, and forming a nonwoven fabric having at least one projection and at least one recess by placing the nonwoven fabric with high-stretch regions and low-stretch regions on a support and spraying a fluid onto the nonwoven fabric with high-stretch regions and low-stretch regions for treatment.

12 Claims, 3 Drawing Sheets

(51) Int. Cl.

| | |
|---|---|
| ***D04H 1/50*** | (2012.01) |
| ***D04H 1/70*** | (2012.01) |
| ***D04H 3/02*** | (2006.01) |
| ***D04H 3/00*** | (2012.01) |
| ***D06C 29/00*** | (2006.01) |
| ***D04H 1/49*** | (2012.01) |
| ***D06C 3/06*** | (2006.01) |
| ***D04H 1/44*** | (2006.01) |

(52) U.S. Cl.

CPC . *D04H 1/70* (2013.01); *D04H 3/00* (2013.01); *D04H 3/02* (2013.01); *D06C 3/00* (2013.01); *D06C 3/06* (2013.01); *D06C 29/00* (2013.01); *Y10T 442/60* (2015.04)

(56) References Cited

U.S. PATENT DOCUMENTS

| | | | | | |
|---|---|---|---|---|---|
| 3,034,180 | A | * | 5/1962 | Greiner et al. | 19/301 |
| 3,059,313 | A | * | 10/1962 | Harmon | 428/198 |
| 3,137,893 | A | * | 6/1964 | Gelpke | 264/555 |
| 3,747,161 | A | * | 7/1973 | Kalwaites | 28/105 |
| 3,816,228 | A | * | 6/1974 | Stumpf | 428/88 |
| 5,098,764 | A | * | 3/1992 | Bassett et al. | 428/131 |
| 5,102,724 | A | * | 4/1992 | Okawahara et al. | 442/199 |
| 5,274,893 | A | * | 1/1994 | Kitamura et al. | 28/105 |
| 5,414,914 | A | * | 5/1995 | Suzuki et al. | 28/105 |
| 5,632,072 | A | * | 5/1997 | Simon et al. | 26/69 R |
| 5,674,587 | A | * | 10/1997 | James et al. | 428/131 |
| 5,895,623 | A | * | 4/1999 | Trokhan et al. | 264/504 |
| 6,739,024 | B1 | * | 5/2004 | Wagner | 28/106 |
| 8,012,388 | B2 | | 9/2011 | Akaki et al. | |
| 2004/0214498 | A1 | * | 10/2004 | Webb et al. | 442/329 |
| 2007/0298220 | A1 | | 12/2007 | Noda et al. | |
| 2010/0049153 | A1 | | 2/2010 | Hashimoto et al. | |
| 2010/0065984 | A1 | | 3/2010 | Akaki et al. | |
| 2010/0209667 | A1 | * | 8/2010 | Mitsuno et al. | 428/152 |
| 2011/0256791 | A1 | * | 10/2011 | Seidel et al. | 442/329 |

FOREIGN PATENT DOCUMENTS

| | | | |
|---|---|---|---|
| EP | 2133453 | A1 | 12/2009 |
| JP | 2007-321289 | A | 12/2007 |
| JP | 2008-106377 | A | 5/2008 |
| JP | 2008-156785 | A | 7/2008 |
| JP | 2009-062650 | A | 3/2009 |
| JP | 2009-62650 | A | 3/2009 |

OTHER PUBLICATIONS

Extended European Search Report issued Jan. 7, 2014, corresponds to European patent application No. 11768979.4.

An International Search Report, dated Jul. 19, 2011, issued in International Application No. PCT/JP2011/059668.

* cited by examiner

METHOD OF EASY PRODUCTION OF NONWOVEN FABRIC HAVING AT LEAST ONE PROJECTION AND AT LEAST ONE RECESS, AND METHOD OF EASY PROCESSING OF NONWOVEN FABRIC

RELATED APPLICATIONS

The present application is based on International Application No. PCT/JP2011/059668, filed Apr. 13, 2011 and claims priority from Japanese Application No. 2010-095235, filed Apr. 16, 2010.

TECHNICAL FIELD

The present invention relates to a method of easy production of a nonwoven fabric having at least one projection and at least one recess and to a method of easy processing of a nonwoven fabric.

BACKGROUND ART

Nonwoven fabrics are used in absorbent articles, such as sanitary products and disposable diapers, cleaning products, such as wipers, and medical goods, such as masks. However, the nonwoven fabrics used in such products usually have functions suited for the particular purposes of the products and their location of use.

With absorbent articles, for example, it is necessary to employ nonwoven fabrics that expand and contract in response to bodily movement during wear or use, without creating an uncomfortable feeling for the user. Disposable diapers require nonwoven fabrics with high elasticity and strength sufficient to prevent tearing during extension, as well as satisfactory feel on the skin and air permeability.

The nonwoven fabrics having desired functions in such products are usually specially designed and produced for each product, and from the viewpoint of production cost and environmental protection, it is preferred for a nonwoven fabric having the desired performance to be one that can be easily produced by modification of a commercially available nonwoven fabric, for example.

As a method for producing a nonwoven fabric suitable for use in an absorbent article comprising a nonwoven fabric as the starting material, PTL 1 discloses a method for producing a nonwoven fabric with low stiffness and excellent flexibility, without collapse or dropping of the ridges and without obstruction of the open holes. Also, in paragraph ** of PTL 1 it is stated that a nonwoven fabric with bonded and entangled fibers may be used as the starting material for the nonwoven fabric.

However, when a commercially available nonwoven fabric, for example, is used as the starting material for the invention described in PTL 1, a high level of energy is required for fluid treatment because the fibers of the nonwoven fabric are fixed and not easily moved. When water vapor or an air stream is used as fluid treatment, the fluid treatment temperature must be increased, but a higher treatment temperature results in fusion of the fibers in the nonwoven fabric and reduced flexibility of the nonwoven fabric that is produced, while also making it difficult to form the desired structure. When a water stream is used as the fluid treatment, a drying step is also necessary.

According to the invention described in PTL 1, a carded web may be used as the starting material, but since using a carded web as the starting material tends to impair the texture of the produced sheet, it becomes necessary to increase the suction force during fluid treatment, resulting in larger production equipment.

CITATION LIST

Patent Literature

PTL 1 Japanese Unexamined Patent Publication No. 2009-62650

SUMMARY OF INVENTION

Technical Problem

The invention described in PTL 1 has had problems, such as described above.

It is therefore an object of the present invention to provide a method of easy production of a nonwoven fabric having at least one projection and at least one recess and to a method of easy processing of a nonwoven fabric.

Solution to Problem

As a result of diligent research directed toward solving the problems described above, the present inventors have found a method of producing a nonwoven fabric having at least one projection and at least one recess, comprising the steps of non-homogeneous stretching a nonwoven fabric so as to form a nonwoven fabric with high-stretch regions and low-stretch regions, and forming a nonwoven fabric having at least one projection and at least one recess by placing the nonwoven fabric with high-stretch regions and low-stretch regions on a support and spraying a fluid onto the nonwoven fabric with high-stretch regions and low-stretch regions for treatment.

Specifically, the present invention relates to the following J1 to J3.

[J1]

A method of producing a nonwoven fabric having at least one projection and at least one recess, comprising the steps of:

non-homogeneous stretching a nonwoven fabric so as to form a nonwoven fabric with high-stretch regions and low-stretch regions, and forming a nonwoven fabric having at least one projection and at least one recess by placing the nonwoven fabric with high-stretch regions and low-stretch regions on a support and spraying a fluid onto the nonwoven fabric with high-stretch regions and low-stretch regions for treatment.

[J2]

The method according to J1, wherein the step of non-homogeneous stretching is carried out by passing the nonwoven fabric through the gap between a pair of gear rolls with rotational axis lines that are perpendicular to the machine direction, and rotating while a plurality of teeth situated on the peripheral surfaces of each of the gear rolls are mutually engaged.

[J3]

The method according to J2, wherein the plurality of teeth are situated around the peripheral surface perpendicular to the rotational axis lines, and a nonwoven fabric is formed having high-stretch regions and low-stretch regions, each parallel to the machine direction, alternating in the cross direction which is perpendicular to the machine direction.

[J4]

The method according to any one of J1 to J3, wherein in the step of forming the nonwoven fabric having at least one projection and at least one recess, the support has protrusions and depressions with predetermined shapes and arrangement on the side in contact with the nonwoven fabric which has high-stretch regions and low-stretch regions.

[J5]

The method according to J4, wherein the protrusions and depressions having predetermined shapes and arrangement are each parallel to the cross direction which is perpendicular to the machine direction, and are situated in an alternating fashion in the machine direction.

[J6]

The method according to any one of J1 to J5, wherein the fluid is selected from the group consisting of air, water vapor and water.

[J7]

The method according to any one of J1 to J6, wherein the nonwoven fabric is selected from the group consisting of air-through nonwoven fabrics, spunbond nonwoven fabrics, point bond nonwoven fabrics and elastic nonwoven fabrics.

[J8]

The method according to any one of J1 to J7, wherein the nonwoven fabric having at least one projection and at least one recess has air permeability in the thickness direction that is at least 3 times the air permeability in the thickness direction of the nonwoven fabric.

[J9]

The method according to any one of J1 to J8, wherein the nonwoven fabric having at least one projection and at least one recess has air permeability in the planar direction of at least 5 $m^3/m^2/min$.

[J10]

The method according to any one of J1 to J9, wherein the nonwoven fabric having at least one projection and at least one recess has a maximum point elongation of 80% or greater in the cross direction which is perpendicular to the machine direction.

[J11]

A nonwoven fabric having at least one projection and at least one recess, formed by the method according to any one of J1 to J10.

[J12]

An absorbent article comprising the nonwoven fabric having at least one projection and at least one recess according to J11.

[J13]

A method of processing a nonwoven fabric comprising the steps of:

non-homogeneous stretching a nonwoven fabric so as to form a nonwoven fabric with high-stretch regions and low-stretch regions, and forming a nonwoven fabric having at least one projection and at least one recess by placing the nonwoven fabric with high-stretch regions and low-stretch regions on a support and spraying a fluid onto the nonwoven fabric with high-stretch regions and low-stretch regions for treatment.

Advantageous Effects of Invention

The method of the invention allows easy production of a nonwoven fabric having at least one projection and at least one recess.

The method of the invention also allows production with smaller-scale equipment than by prior art production methods.

DESCRIPTION OF EMBODIMENTS

Figure 1:
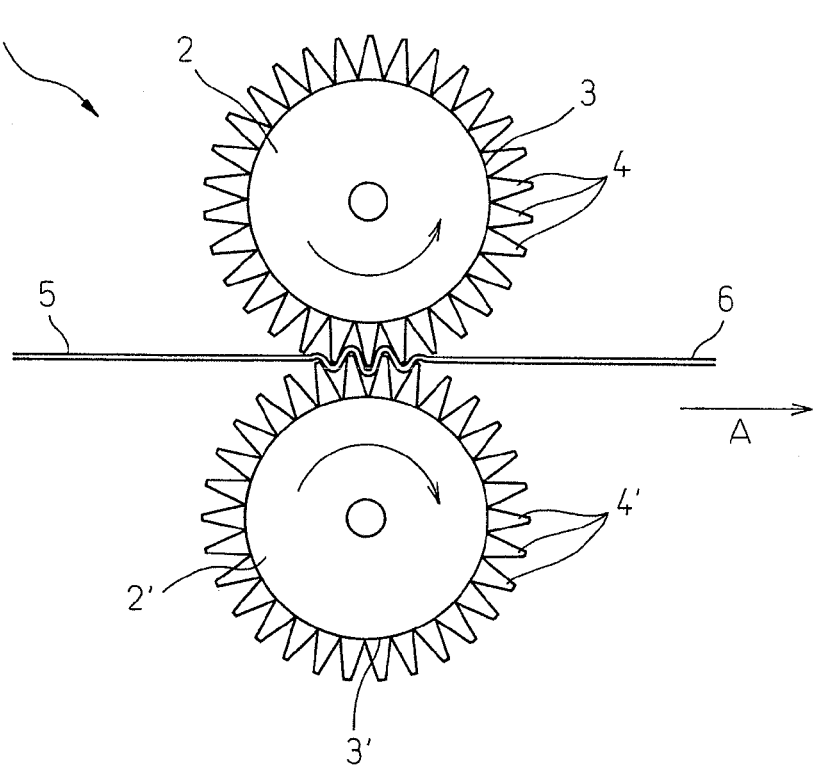
FIG. 1 is a diagram illustrating gear stretching.

The method of producing a nonwoven fabric having at least one projection and at least one recess and the method of processing a nonwoven fabric according to the invention will now be described in detail.

The method of the invention comprises a step of non-homogeneous stretching a nonwoven fabric so as to form a nonwoven fabric having high-stretch regions and low-stretch regions (this will hereunder also be referred to as "non-homogeneous stretching step").

The nonwoven fabric may employ such fibers that are used in the technical field, without any particular restrictions. Examples of fibers include natural fibers, semi-natural fibers and synthetic fibers. The fibers are preferably synthetic fibers. This will avoid excessive compacting of the fibers during the step of forming the nonwoven fabric having at least one projection and at least one recess, described hereunder, for high flexibility of the formed nonwoven fabric having at least one projection and at least one recess. The proportion of synthetic fibers in the nonwoven fabric is preferably at least about 50 mass %, more preferably at least about 70% and even more preferably about 100 mass % of the total fiber. A higher proportion of synthetic fibers will tend to result in resistance to collapse even when the user applies body pressure, and also satisfactory air permeability. The material of the synthetic fibers may be polyethylene, polypropylene, polyester or the like.

From the viewpoint of moldability, the fibers preferably have sizes of about 1 to 6 dtex.

The fiber lengths of the fibers are not particularly restricted, and there may be mentioned staple fibers and continuous filaments, for example. When two or more fibers are mixed, the fiber lengths of the fibers may be the same or different.

The fiber structure may be a core-sheath structure or side-by-side structure, which are autohesive fibers.

The nonwoven fabric may comprise extendable fiber, elastic fiber, or a combination thereof.

As used herein, "elastic fiber" means fiber that is capable of elastic stretching. More specifically, the elastic fiber is fiber that has a larger elastic limit than the stress applied during formation and during expected use, and that is capable of elastic stretching within the range of stress during formation and during expected use. Examples of elastic fiber materials include polyurethane-based elastomers, polystyrene-based elastomers, polyolefin-based elastomers, polyamide-based elastomers, polyester-based elastomers, and combinations thereof. The elastic fiber is preferably a polyurethane-based elastomer, from the viewpoint of low distortion after stretching and high heat resistance.

The fiber size of the elastic fiber is preferably in the range of 2-50 μm and more preferably in the range of 15-30 μm.

As used herein, "extendable fiber" means fiber having a smaller elastic limit than the elastic limit of the aforementioned elastic fiber. More specifically, the extendable fiber is fiber having a smaller elastic limit than the stress applied during formation, and capable of plastic deformation by the stress applied during formation. The extendable fiber becomes thinner and longer by plastic deformation. As used herein, extendable fiber that has undergone plastic deformation by the stress of formation will sometimes be referred to as "stretched extendable fiber". An example of stretched extendable fiber is fiber having a uniform diameter, or fiber having a non-uniform diameter, such as one having partial thin sections (necking sections).

Examples of extendable fiber materials include fibers made of polyolefins, such as polyethylene and polypropylene, and polystyrenes, polyesters, polyamides, polyurethanes and polylactic acids, and combinations thereof. The extendable fiber may be composite fiber, such as core-sheath fiber or side-by-side fiber.

The extendable fiber is preferably fiber comprising polypropylene and polyethylene, from the viewpoint of low crystallinity and high elongation.

The fiber size of the extendable fiber is preferably in the range of about 1 to about 40 μm, and more preferably in the range of about 5 to about 25 μm. The fiber size of the extendable fiber is also preferably smaller than the fiber size of the elastic fiber. This will allow flexibility, high bulk and a masking property to be imparted to the nonwoven fabric of the invention.

The nonwoven fabric is not particularly restricted, and it may be a nonwoven fabric produced by any known method, such as an air-through nonwoven fabric, spunbond nonwoven fabric, point bond nonwoven fabric, spunlace nonwoven fabric, airlaid nonwoven fabric, meltblown nonwoven fabric, nanofiber-containing nonwoven fabric, or elastic nonwoven fabric.

An elastic nonwoven fabric is a nonwoven fabric containing elastic fibers.

The nonwoven fabric is preferably an air-through nonwoven fabric, spunbond nonwoven fabric, point bond nonwoven fabric or elastic nonwoven fabric.

The nonwoven fabric may be any commercially available nonwoven fabric, used directly.

The nonwoven fabric preferably has a hydrophilic property. This will allow contacted hydrophilic excreta (urine, sweat, stool, etc.) to pass through the interior of the nonwoven fabric more easily without remaining on the surface of the nonwoven fabric.

Examples of nonwoven fabrics with a hydrophilic property include nonwoven fabrics produced by treatment of a hydrophobic nonwoven fabric with a hydrophilic agent, nonwoven fabrics produced from composite fibers incorporating a hydrophilic agent, and nonwoven fabrics coated with a surfactant. Nonwoven fabrics with a hydrophilic property also include nonwoven fabrics produced from fibers with innate hydrophilicity, such as natural and/or semi-synthetic fibers.

As used herein, the term "nonwoven fabric" used alone refers to the nonwoven fabric before non-homogeneous stretching. The nonwoven fabric before non-homogeneous stretching will also be referred to as "nonwoven fabric prior to processing".

The non-homogeneous stretching step is carried out in the nonwoven fabric partially (i) to destroy the points of fiber contact in the nonwoven fabric and create a partial web state of the anchored fibers, and/or (ii) to cause plastic deformation of the fibers between the points of fiber contact in the nonwoven fabric, to render them thinner and longer. For (ii), the fibers that have undergone plastic deformation to be rendered thinner and longer may have uniform diameters, or they may have non-uniform diameters, such having partial thin sections (necking sections). By causing plastic deformation of the fibers between the points of fiber contact in the nonwoven fabric to render them thinner and longer, as in (ii) above, the volume of fibers that are mobile during fluid treatment will be increased and irregularities will form more easily in the nonwoven fabric.

As used herein, extendable fiber that has undergone plastic deformation by the stress of formation will sometimes be referred to as "extended fiber".

The points of contact may be heat sealing points, in the case of an air-through nonwoven fabric, or they may be thermo-compression bonding points in the case of a spunbond nonwoven fabric or point bond nonwoven fabric, or fiber tangling points in the case of a spunlace nonwoven fabric.

As used herein, "high-stretch region" means a region that has been stretched so that the degree of stretch of the extended fiber is higher than in the low-stretch regions, while "low-stretch region" means a region that has been stretched so that the degree of stretch of the extended fiber is lower than in the high-stretch regions, and it includes regions in which no extended fiber has been formed, i.e. unstretched regions.

Also as used herein, the term "non-homogeneous stretching" refers to stretching so as to form a nonwoven fabric having high-stretch regions and low-stretch regions, or in other words, stretching so as to form a nonwoven fabric having different degrees of stretching of the extended fiber, depending on the location.

This step is not particularly restricted so long as it allows formation of a nonwoven fabric with high-stretch regions and low-stretch regions, and it may be carried out by any desired means, such as passing the nonwoven fabric through the gap between a pair of gear rolls each having a rotational axis line perpendicular to the machine direction and rotating while engaging the plurality of teeth situated around the peripheral surface of each gear roll (this will hereunder also be referred to as "gear stretching").

FIG. 1 is a diagram illustrating gear stretching. The gear stretcher 1 shown in FIG. 1 has a pair of gear rolls 2 and 2'. A plurality of teeth 4 and 4' are situated around the peripheral surfaces 3 and 3' of the gear rolls 2 and 2'. In the gear stretcher 1 shown in FIG. 1, the rotational axis lines of the gear rolls 2 and 2' are both perpendicular to the machine direction A of the nonwoven fabric. The plurality of teeth 4 and 4' are situated on the peripheral surfaces 3 and 3' in a manner parallel to the rotational axis lines.

In the gear stretcher 1 shown in FIG. 1, the nonwoven fabric 5 is passed through the roll gap between the pair of gear rolls 2 and 2', and when it passes through the gear rolls 2 and 2', the nonwoven fabric 5 is stretched by the mutually engaging plurality of teeth 4 and 4' of the gear rolls 2 and 2', on the three-point bending principle, to form a nonwoven fabric 6 having high-stretch regions and low-stretch regions. The nonwoven fabric 6 having high-stretch regions and low-stretch regions has alternating high-stretch regions and low-stretch regions in the machine direction A, which are parallel to the cross direction that is perpendicular to the machine direction A (hereunder, the cross direction that is perpendicular to the machine direction will be referred to simply as the "cross direction").

In the nonwoven fabric 5, the fabric material of the nonwoven fabric is anchored in the regions that are in contact with the tips of the plurality of teeth 4 and 4', and therefore undergoes little or no stretching, forming the low-stretch regions. On the other hand, large stretching occurs in the regions that are not in contact with the tips of the plurality of teeth 4 and 4', forming the high-stretch regions.

Figure 2:
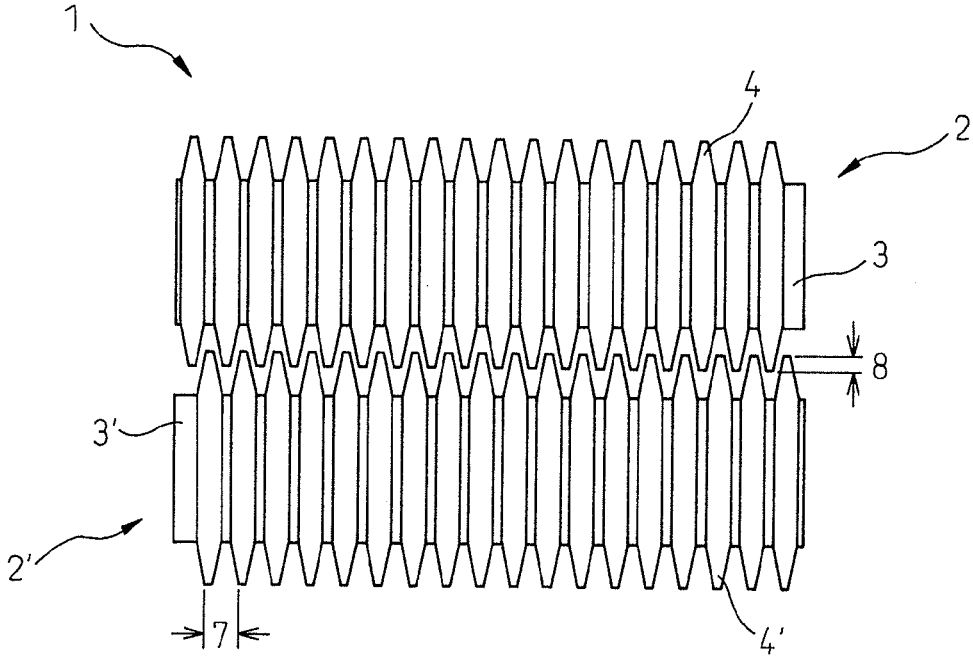
FIG. 2 is a diagram illustrating gear stretching.

Gear stretching can also be accomplished using a gear stretcher as shown in FIG. 2.

FIG. 2 is a diagram illustrating gear stretching.

The gear stretcher 1 shown in FIG. 2 has a pair of gear rolls 2 and 2'. A plurality of teeth 4 and 4' are situated around the peripheral surfaces 3 and 3' of the gear rolls 2 and 2'. In the gear stretcher 1 shown in FIG. 2, the plurality of teeth 4 and 4' are situated on the respective peripheral surfaces 3 and 3' in a manner perpendicular to the rotational axis lines of the gear rolls 2 and 2'. When the plurality of teeth 4 and 4' are situated in this manner, it is possible to form a nonwoven fabric having parallel high-stretch regions and low-stretch regions, parallel to the machine direction A, and alternating in the cross direction.

The gear stretcher may also have a plurality of teeth situated around the peripheral surfaces of gear rolls, and slanted with respect to the rotational axis lines of the gear rolls.

The gear stretcher may be appropriately selected depending on the desired performance for the nonwoven fabric having at least one projection and at least one recess that is to be formed.

For example, when high extensibility is required in both the machine direction and its cross direction, the nonwoven fabric may be stretched using the gear stretcher shown in FIG. 1, and then further stretched using the gear stretcher shown in FIG. 2.

Alternatively, the nonwoven fabric may be stretched using the gear stretcher shown in FIG. 2, and then further stretched using the gear stretcher shown in FIG. 1.

In these gear stretchers, the gear pitch is preferably about 1 to 10 mm and more preferably about 2 to 6 mm. If the gear pitch is less than about 1 mm it may be necessary to reduce the thickness of the gear blades and portions of the nonwoven fabric may be severed, while if the gear pitch is greater than about 10 mm, the draw ratio may be reduced and the fibers may become webbed and/or plastic deformation of the fibers may be insufficient.

The gear pitch is the interval between one tooth and another tooth, and it is denoted by numeral 7 in FIG. 2.

In this gear stretcher, the gear tooth cutting depth is preferably about 0.5 mm or greater. If the gear tooth cutting depth is less than about 0.5 mm, the nonwoven fabric stretching may be inadequate and it may be difficult to form high-stretch regions.

The gear tooth cutting depth is the depth at the section where the top gear roll tooth and bottom gear roll tooth overlap, and it is denoted by numeral 8 in FIG. 2.

In a nonwoven fabric having high-stretch regions and low-stretch regions, the draw ratio in the direction of stretching is preferably about 30-400% and more preferably about 50-200%. If the draw ratio is less than about 30%, the nonwoven fabric may undergo elastic deformation and high-stretch regions will essentially fail to form in the nonwoven fabric, while if the draw ratio is greater than about 400%, the strength of the nonwoven fabric having high-stretch regions and low-stretch regions may be weak, the extended fibers may tend to shed off, and transport may be impeded.

As used herein, the term "draw ratio" refers to the value calculated by the following formula:

$$\text{Draw ratio}(\%) = 100 \times \left[\frac{\sqrt{P^2 + 4D^2}}{P} - 1\right]$$

where P is the gear pitch and D is the gear tooth cutting depth.

The reel-off speed of the nonwoven fabric will vary depending on the desired draw ratio, but it may be about 10 m/min or greater, for example. The take-up speed of the nonwoven fabric having alternating high-stretch regions and low-stretch regions will vary depending on the draw ratio, etc., and when the nonwoven fabric has been stretched in the machine direction, the value of the draw ratio on the reel-off speed serves as a measure of the take-up speed.

The method of the invention comprises a step of forming a nonwoven fabric having at least one projection and at least one recess by placing the nonwoven fabric having high-stretch regions and low-stretch regions on a support, and spraying a fluid onto the nonwoven fabric having high-stretch regions and low-stretch regions for treatment.

At least a portion of the web fiber and/or extended fiber present in the high-stretch regions, formed in the non-homogeneous stretching step, is impacted with the sprayed fluid on the side impacting with the fluid (hereunder referred to as "fluid-impacting side"), and is then rebounded and separated out in a planar direction, such as the cross direction. Also, on the side opposite the fluid-impacting side (hereunder referred to as "non-fluid-impacting side"), at least a portion of the web fiber and/or extended fiber moves along the flow of the fluid passing through the nonwoven fabric having high-stretch regions and low-stretch regions.

The fluid used in the step of forming the nonwoven fabric having at least one projection and at least one recess may be air, such as heated air, or water vapor, or water, such as hot water.

The fluid may be blasted from an anchored fluid nozzle onto the nonwoven fabric having high-stretch regions and low-stretch regions, or it may be blasted from a fluid nozzle that is reciprocating in the cross direction. The fluid may also be continuously or intermittently blasted from a fluid nozzle onto the nonwoven fabric having high-stretch regions and low-stretch regions. These may also be used in combinations.

The fluid may be appropriately selected depending on the form of the nonwoven fabric having high-stretch regions and low-stretch regions. For example, for treatment of a nonwoven fabric with a low gear pitch and a large draw ratio, air or water vapor is preferably selected as the fluid as this will allow movement of primarily the extended fiber with relatively low energy. Furthermore, since the joining points between fibers are increased in number when using a nonwoven fabric with a large gear pitch and many low-stretch regions, a relatively high energy is necessary for movement of the extended fiber, and therefore water or water vapor is preferably selected as the fluid, with water vapor being more preferred. This is because moisture does not easily remain in the sections with a large composite fiber content and the joining points between the sections with a high composite fiber content are not usually destroyed, so that the extended fibers in the sections that are to undergo movement can easily move.

The step of forming the nonwoven fabric having at least one projection and at least one recess can be carried out by a known method using an apparatus known in the technical field.

According to one embodiment of the invention, the support used to support the nonwoven fabric with high-stretch regions and low-stretch regions may be a support commonly used in the technical field, such as a metal or plastic conveyor net, or a paper making web. The support will usually be one with fluid permeability.

According to a different embodiment of the invention, a support having protrusions and depressions may be used for further improved air permeability, feel on the skin (for example, low contact area) and liquid uptake properties of the nonwoven fabric having at least one projection and at least one recess.

According to the invention, a "protrusion" is a section used to form a recess on the surface of the support side of the nonwoven fabric having high-stretch regions and low-stretch regions, while "depression" is a section used to form a projection on the surface of the support side of the nonwoven fabric having high-stretch regions and low-stretch regions.

Figure 3:
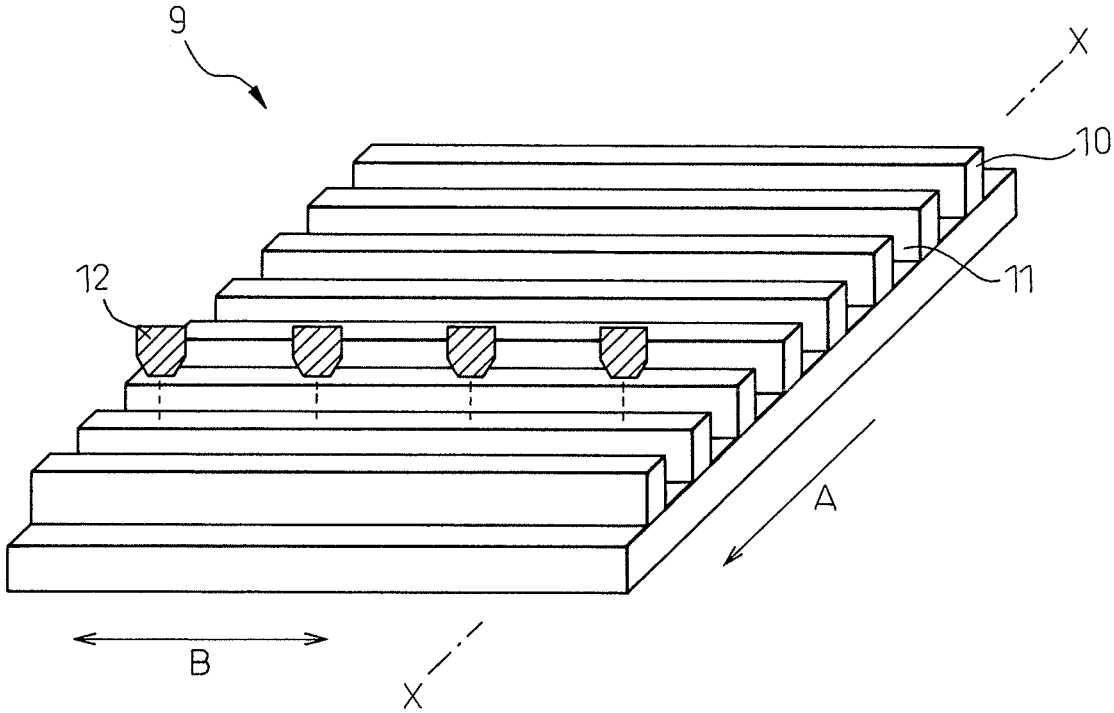
FIG. 3 is a diagram showing an example of a support for a nonwoven fabric having high-stretch regions and low-stretch regions, to be used on a conveyor.

FIG. 3 is a diagram showing an example of a support used on a conveyor.

In FIG. 3, the support 9 has protrusions 10 and depressions 11 running parallel in the cross direction B, and the protrusions 10 and depressions 11 of the support 9 are situated in an alternating fashion in the machine direction A. A fluid nozzle 12 is also shown in FIG. 3, and below the fluid nozzle 12 under the support 9 there is provided a suction section (not shown) that receives fluid. In FIG. 3, the protrusions 10 and depressions 11 have cubic shapes, and are disposed in an alternating arrangement.

Also, the protrusions and depressions in FIG. 3 are situated parallel to the cross direction and alternating in the machine direction, but there are no particular restrictions on the shapes and arrangement of the protrusions and depressions for the method of the invention, and for example, the protrusions and depressions: (i) may be protrusions and depressions that are all parallel to the machine direction and alternatingly disposed in the cross direction, (ii) may be protrusions and depressions that are slanted with respect to the machine direction and alternatingly disposed in the direction perpendicular to the slanted direction, or (iii) may be protrusions and/or depressions having predetermined shapes (for example, cubic, cylindrical or hemispherical) that are disposed in a predetermined arrangement (for example, a heart-shaped or star-shaped arrangement).

When a support having protrusions and depressions is used, it is possible to form a nonwoven fabric having at least one projection and at least one recess having higher projections and deeper recesses (with one or more open holes depending on the case), than when using a support without protrusions and depressions.

This phenomenon will be concretely described with reference to FIG. 3. When the fluid sprayed from the fluid nozzle 12 impacts the protrusions 10, it flows into and around the depressions 11. As a result, the extended fibers that have a high degree of freedom move with the fluid flow toward the depressions 11, such that the amount of fiber per unit area is reduced at the locations where the fluid and the protrusions 10 cross, forming recesses in the nonwoven fabric with high-stretch regions and low-stretch regions and in some cases forming one or more open holes, while the amount of fiber per unit area is increased at the locations where the fluid and the depressions 11 cross, forming projections in the nonwoven fabric with high-stretch regions and low-stretch regions. Since the extended fibers tend to rise in the thickness direction of the nonwoven fabric having at least one projection and at least one recess at the projections, the nonwoven fabric having at least one projection and at least one recess is imparted with compression resistance and also an improved fluid take-up property. In addition, because it has projections, it has excellent air permeability, and especially air permeability in the planar direction, and has superior feel on the skin due to its low contact area.

A nonwoven fabric having at least one projection and at least one recess, formed using a support having protrusions and depressions, has higher projections and deeper recesses (with one or more open holes depending on the case), than a nonwoven fabric formed using a support without protrusions and depressions, and therefore it has higher air permeability, and especially superior air permeability in the planar directions, compression resistance, fluid take-up and feel on the skin, compared to a nonwoven fabric formed using a support without protrusions and depressions.

Of the air permeability in the planar directions, the nonwoven fabric having at least one projection and at least one recess formed using the support shown in FIG. 3 has particularly excellent air permeability in the cross direction. This is because the recesses in the nonwoven fabric having at least one projection and at least one recess, corresponding to the protrusions of the support, can serve as gas channels.

The protrusions preferably have lower fluid permeability than the fluid permeability of the depressions. This is because with low fluid permeability at the protrusions, the fluid impacting the protrusions will flow toward the depressions, thus allowing formation of greater projections in the nonwoven fabric having at least one projection and at least one recess formed by the method of the invention.

The material of the protrusions may be metal, plastic or the like.

The protrusions and depressions are not particularly restricted, and for example, they may be formed by situating cubic or tubular-shaped metal in a predetermined arrangement, while maintaining a fixed spacing, for example, on a metal or plastic conveyor net, paper-making web or punching plate that is commonly used as a fluid-permeable support.

Examples of supports having protrusions and/or depressions with predetermined shapes (for example, cubic, cylindrical or hemispherical) disposed in a predetermined form (for example, heart-shaped or star-shaped) include supports having hemispherical metal situated in a predetermined arrangement (such as a heart-shaped arrangement) on a punching plate. When such a support is used, it is possible to form a nonwoven fabric having recesses in a predetermined pattern (for example, heart-shaped).

Also, by using a support with protrusions and depressions, in which hemispherical dent shapes are disposed in a predetermined pattern (such as a heart-shaped pattern) on a punching plate, it is possible to form a nonwoven fabric having projections in a predetermined pattern (such as a heart-shaped pattern).

When the step of forming the nonwoven fabric having at least one projection and at least one recess is to be carried out on a roll, a roll-like support may be used, having the outer periphery constructed of a fluid-permeable material, such as a mesh and having protrusions and depressions situated with predetermined shapes and a predetermined arrangement, on the peripheral surface. The predetermined shapes and arrangement may be the shapes and arrangement described above.

Figure 4:
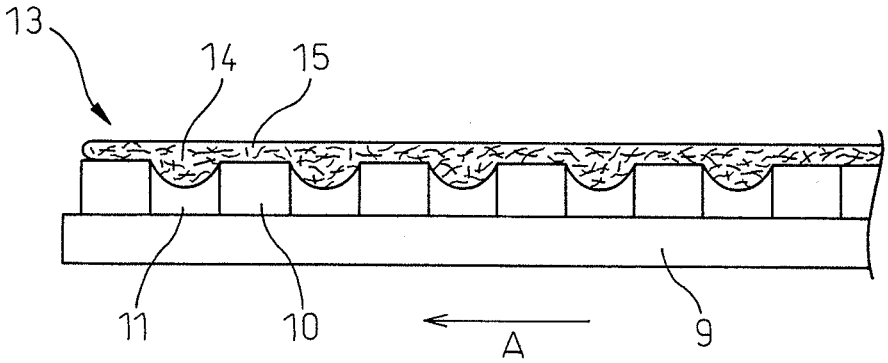
FIG. 4 is a diagram showing a nonwoven fabric having at least one projection and at least one recess, formed using the support shown in FIG. 3.

FIG. 4 is a diagram showing a nonwoven fabric having at least one projection and at least one recess 13, formed using the support 9 shown in FIG. 3. FIG. 4 corresponds to a cross-section along X-X in FIG. 3. In FIG. 4, the projections 14 of the nonwoven fabric having at least one projection and at least one recess are formed in the depressions 11 of the support 9, while the recesses 15 of the nonwoven fabric having at least one projection and at least one recess are formed on the protrusions 10 of the support 9.

Figure 5:
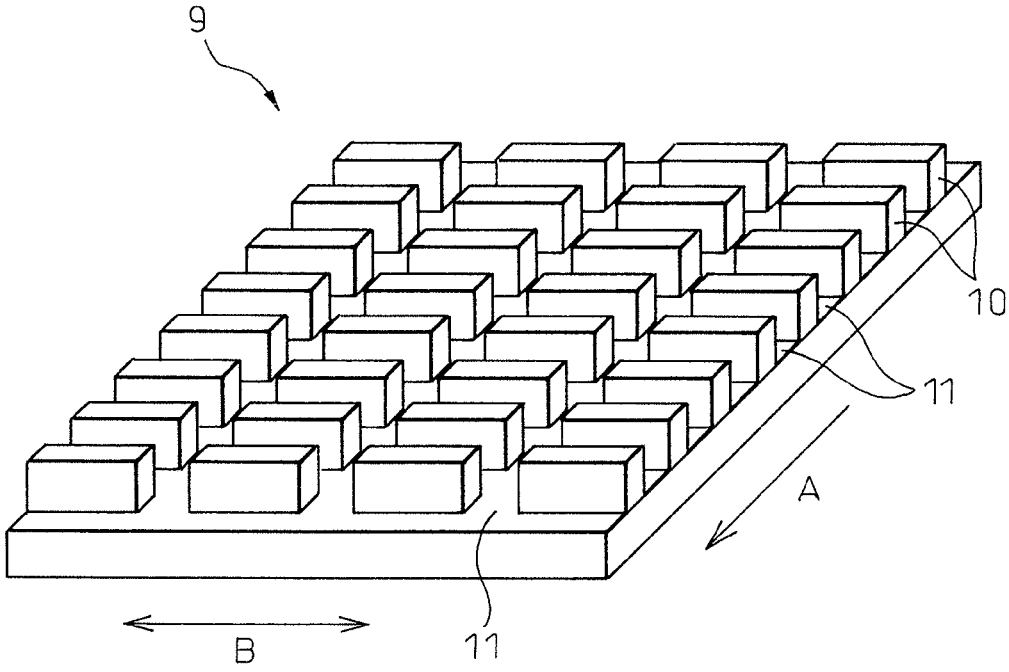
FIG. 5 is a diagram showing another example of a support for a nonwoven fabric having high-stretch regions and low-stretch regions, to be used on a conveyor.

According to yet another embodiment of the invention, the support shown in FIG. 5 may be used. The protrusions 10 and depressions 11 have cubic and lattice shapes, respectively, in the support 9 shown in FIG. 5, and the protrusions 18 are disposed in an arrangement with a fixed spacing in the machine direction and the cross direction.

In a support having protrusions and depressions, their widths will differ depending on the properties required for the nonwoven fabric having at least one projection and at least one recess that is to be formed, but as an example, the support shown in FIG. 3 preferably has protrusion widths in the range of about 0.5 to about 10 mm, and depression widths in the range of about 1 to about 10 mm.

The nonwoven fabric having at least one projection and at least one recess, formed by the method of the invention, has improved air permeability, extensibility, feel on the skin and fluid take-up.

The improved air permeability may be improvement such that the nonwoven fabric having at least one projection and at least one recess has, for example, air permeability in the thickness direction that is at least about 3 times greater, air permeability in the thickness direction that is at least about 4 times greater, or air permeability in the thickness direction that is at least about 5 times greater, than the air permeability in the thickness direction of the nonwoven fabric prior to processing.

Such improved air permeability may also be improvement such that the air permeability in the planar direction of the nonwoven fabric having at least one projection and at least one recess is, for example, at least about 5 $m^3/m^2/min$, at least about 10 $m^3/m^2/min$ or at least about 15 $m^3/m^2/min$.

The improved elasticity may be improvement such that the maximum point elongation in the cross direction of the nonwoven fabric having at least one projection and at least one recess is at least about 80%, at least about 90% or at least about 100%.

The improved feel on the skin may be improvement such that the nonwoven fabric having at least one projection and at least one recess generally has bulk of at least about 1.3 times greater, bulk of at least about 1.5 times greater or bulk of at least about 1.8 times greater, than the bulk of the nonwoven fabric prior to processing.

A nonwoven fabric having at least one projection and at least one recess, formed by the method of the invention, is useful for absorbent articles, such as sanitary products and disposable diapers, cleaning products, such as wipers, and medical goods, such as masks.

A nonwoven fabric having at least one projection and at least one recess formed by the method of the invention can be used as a liquid-permeable top sheet for an absorbent article, for example. By using a nonwoven fabric having at least one projection and at least one recess, formed by the method of the invention, which has improved air permeability, extensibility, feel on the skin and fluid take-up, it is possible to produce an absorbent article with excellent air permeability, extensibility, feel on the skin and fluid take-up.

The absorbent article comprises a nonwoven fabric having at least one projection and at least one recess, formed by the method of the invention, as a liquid-permeable top sheet, and a liquid-impermeable back sheet that is known in the technical field, as well as an absorbent body situated between them.

EXAMPLE

The invention will now be explained in greater detail using examples and comparative examples, with the understanding that the invention is in no way limited by the examples.

The evaluated properties and measuring conditions in the examples and comparative examples were as follows.

[Fiber Size]

The fiber size was determined as the arithmetic mean of fiber sizes of 50 arbitrarily picked-up fibers in a specimen observed at 300× magnification with an acceleration voltage of 5 kV using a VE-7800 Real Surface View microscope by Keyence Corp.

[Basis Weight]

The basis weight was measured according to JIS L 1906, 5.2.

[Bulk]

The bulk was measured using a THICKNESS GAUGE UF-60 by Daiei Kagaku Seiki Mfg. Co., Ltd.

[Strength and Elongation]

The strength and elongation were measured using a Model AG-KNI autograph tensile tester by Shimadzu Corp.

A sample with a 50 mm width was anchored to a chuck with a chuck distance of 100 mm, and extended at a pull rate of 100 mm/min. The maximum value of the strength obtained during extension was recorded as the "maximum point strength", and the elongation at that time was recorded as the "maximum point elongation".

"MD" in the table indicates the machine direction during formation of the fabric, and "CD" indicates the cross direction during formation of the fabric.

[Air Permeability]

The air permeability was measured using a KES-F8-AP1 air permeability tester by Kato Tech Corp., with calculation in units of $m^3/m^2/min$.

The air permeability in the thickness direction of the nonwoven fabric was measured by setting the nonwoven fabric, cut to a size of 100 mm×100 mm, in the air permeability tester.

The air permeability in the planar direction of the nonwoven fabric was measured with the nonwoven fabric cut to a size of 100 mm×100 mm and set in the air permeability tester, a 100 mm×100 mm acrylic board set thereover and application of a pressure of 3.5 $mN/cm^2$.

Example 1

—Gear Stretching—

As the nonwoven fabric prior to processing there was prepared a spunbond nonwoven fabric (basis weight: 20 $g/m^2$), and the gear stretcher shown in FIG. 2 (gear pitch: 2.5 mm, gear tooth cutting depth: 3.0 mm, throughput: 30 m/min) was used to form a gear-stretched nonwoven fabric. The gear-stretched nonwoven fabric had high-stretch regions and low-stretch regions parallel to the machine direction, alternating in the cross direction perpendicular to the machine direction. The draw ratio of the gear-stretched nonwoven fabric in the cross direction was 160%.

In the gear-stretched nonwoven fabric, embossed sections remained in the low-stretch regions that were in contact with the tips of the teeth. In the high-stretch regions that were not in contact with the tips of the teeth, some of the embossed sections had been crushed, forming web regions.

The properties of the spunbond nonwoven fabric and gear-stretched nonwoven fabric are shown in Table 1.

—Steam treatment—

The gear-stretched nonwoven fabric was placed on a support having protrusions and depressions each parallel to the cross direction, and alternating in the machine direction, such as shown in FIG. 3. The protrusions did not transmit the fluid, and their widths and heights were 3 mm and 5 mm, respectively. The widths of the depressions were 2 mm. The gear treated nonwoven fabric was then passed through a steam treatment system (spray pressure: 0.7 Mpa, water vapor temperature: 162° C.) comprising a plurality of nozzles (ϕ: 0.5 mm) at a spacing of 2.0 mm, at a speed of 5 m/min, to obtain nonwoven fabric 1.

The properties of the nonwoven fabric 1 are shown in Table 1.

Example 2

Nonwoven fabric 2 was obtained in the same manner as Example 1, except that the spunbond nonwoven fabric was changed to a point bond nonwoven fabric (basis weight: 24 g/m$^2$).

It was confirmed that the bulk of the point bond nonwoven fabric was increased, and the air permeability improved, by gear stretching.

The properties of the point bond nonwoven fabric, the gear-stretched point bond nonwoven fabric and nonwoven fabric 2 are shown in Table 1.

Example 3

Nonwoven fabric 3 was obtained in the same manner as Example 1, except that the spunbond nonwoven fabric was changed to an air-through nonwoven fabric (basis weight: 26 g/m$^2$).

In the gear-stretched air-through nonwoven fabric, fused sections remained in the low-stretch regions that were in contact with the tips of the teeth. In the high-stretch regions that were not in contact with the tips of the teeth, some of the fused sections had been crushed, forming web regions.

The properties of the air-through nonwoven fabric, gear-stretched air-through nonwoven fabric and nonwoven fabric 3 are shown in Table 1.

Example 4

Nonwoven fabric 4 was obtained in the same manner as Example 1, except that the spunbond nonwoven fabric was changed to a spunlace nonwoven fabric (basis weight: 52 g/m$^2$).

A spunlace nonwoven fabric has a structure with densely entangled fibers, and therefore the entanglement of fibers was maintained even after gear stretching, and the bulk was relatively high.

The properties of the spunlace nonwoven fabric, gear-stretched spunlace nonwoven fabric and nonwoven fabric 4 are shown in Table 1.

Example 5

Nonwoven fabric 5 was obtained in the same manner as Example 1, except that the spunbond nonwoven fabric was changed to an elastic nonwoven fabric (basis weight: 28 g/m$^2$, an integral nonwoven fabric obtained by heat embossing a fiber web comprising 50 mass % polyurethane fiber and 50 mass % polyolefin fiber).

The properties of the elastic nonwoven fabric, gear-stretched elastic nonwoven fabric and nonwoven fabric 5 are shown in Table 1.

Comparative Example 1

An air-through nonwoven fabric (basis weight: 29 g/m$^2$) was prepared and subjected to the steam treatment described in Example 1 twice to form nonwoven fabric 6. No gear stretching treatment was carried out for nonwoven fabric 6.

The property values of the air-through nonwoven fabric and nonwoven fabric 6 are shown in Table 1.

TABLE 1

| | | Example 1 | Example 2 | Example 3 | Example 4 | Example 5 | Comp. Example 1* |
|---|---|---|---|---|---|---|---|
| General purpose nonwoven fabric | | | | | | | |
| Fiber size | μm | 20.0 | 19.5 | 19.9 | 14.0 | 23.0 | 19.3 |
| Basis weight | g/m$^2$ | 19.8 | 23.8 | 26.0 | 51.6 | 27.8 | 28.6 |
| Bulk | mm | 0.21 | 0.22 | 0.36 | 0.37 | 0.18 | 0.25 |
| MD Maximum point strength | N/50 mm | 51.4 | 37.3 | 40.8 | 104.0 | 27.8 | 61.2 |
| MD Maximum point elongation | % | 35.8 | 24.2 | 37.6 | 25.1 | 137.7 | 33.4 |
| CD Maximum point strength | N/50 mm | 14.2 | 8.5 | 9.5 | 20.4 | 11.5 | 10.2 |
| CD Maximum point elongation | % | 66.9 | 36.7 | 82.6 | 118.1 | 185.6 | 80.3 |
| Air permeability (thickness direction) | m$^3$/m$^2$/min | 326 | 245 | 562 | 89 | 231 | 391 |
| Air permeability (planar direction) | m$^3$/m$^2$/min | 0 | 1 | 1 | 0 | 0 | 0 |
| Gear-stretched nonwoven fabric | | | | | | | |
| Basis weight | g/m$^2$ | 18.0 | 19.5 | 22.5 | 36.2 | 27.1 | — |
| Bulk | mm | 0.30 | 0.36 | 0.61 | 0.62 | 0.43 | — |
| Air permeability (thickness direction) | m$^3$/m$^2$/min | 588 | 661 | 946 | 260 | 422 | — |
| Air permeability (planar direction) | m$^3$/m$^2$/min | 1 | 3 | 8 | 5 | 3 | — |

TABLE 1-continued

| | | Example 1 | Example 2 | Example 3 | Example 4 | Example 5 | Comp. Example 1* |
|---|---|---|---|---|---|---|---|
| Steam-treated nonwoven fabric | | | | | | | |
| Fiber size | μm | 19.3 | 19.2 | 20.0 | 12.7 | 19.5 | 19.4 |
| Basis weight | $g/m^2$ | 15.3 | 18.4 | 18.3 | 33.3 | 25.7 | 28.7 |
| Bulk | mm | 0.38 | 0.44 | 0.48 | 0.56 | 0.45 | 0.78 |
| MD Maximum point strength | N/50 mm | 18.0 | 16.2 | 23.7 | 27.9 | 21.1 | 61.6 |
| MD Maximum point elongation | % | 31.0 | 32.8 | 47.8 | 31.1 | 138.6 | 39.4 |
| CD Maximum point strength | N/50 mm | 3.1 | 3.6 | 5.6 | 5.6 | 12.0 | 10.7 |
| CD Maximum point elongation | % | 118.1 | 87.9 | 92.4 | 98.2 | 180.4 | 70.2 |
| Air permeability (thickness direction) | $m^3/m^2/min$ | 1557 | 1661 | 1779 | 429 | 1225 | 502 |
| Air permeability (planar direction) | $m^3/m^2/min$ | 5 | 15 | 57 | 26 | 12 | 2 |

*Steam treatment repeated twice.

The nonwoven fabrics formed in Examples 1 to 5 all had air permeability of at least 3 times greater (in both the thickness direction and planar direction) than the respective nonwoven fabrics before processing. Also, the nonwoven fabrics formed in Examples 1 to 5 all essentially maintained strength in the machine direction during formation, and exhibited dimensional stability.

In Examples 1 to 5, the web-like fibers in the high-stretch regions rapidly migrated to form projections during steam treatment, and therefore very little fusion was observed between the fibers by the heat of steam treatment. In addition, since the nonwoven fabrics formed in Examples 1 to 5 all had projections, the air permeability in the planar direction was high when measured in a pressed state, and since they had recesses, the air permeability in the thickness direction was high.

The nonwoven fabric formed in Comparative Example 1 had a bulk of 0.78 mm, which would appear to be high bulk, yet fibers remained in the recesses. This was attributed to the fact that, while the fibers were unable to move due to the high strength of heat sealing between the fibers, the heat applied during the second steam treatment caused the nonwoven fabric to undergo heat deformation along the shape of the support. It was thus confirmed that compression caused the projections to collapse and the recesses to be filled, thus easily lowering the air permeability.

REFERENCES SIGNS LIST

1 Gear stretcher
2,2' Gear rolls
3,3' Peripheral surfaces
4,4' Teeth
5 Nonwoven fabric
6 Nonwoven fabric with high-stretch regions and low-stretch regions
7 Gear pitch
8 Gear tooth cutting depth
9 Support
10 Protrusion
11 Depression
12 Fluid nozzle
13 Nonwoven fabric having at least one projection and at least one recess
14 projection
15 Recess
A Machine direction
B Cross direction

The invention claimed is:

1. A method of producing a nonwoven fabric having at least one projection and at least one recess, the method comprising:

non-homogeneous stretching a nonwoven fabric so as to form high-stretch regions and low-stretch regions in the nonwoven fabric, and forming at least one projection and at least one recess by placing the nonwoven fabric with the high-stretch regions and the low-stretch regions on a fluid-permeable support, and spraying a fluid from a fluid nozzle onto the nonwoven fabric with the high-stretch regions and the low-stretch regions for treatment, wherein the fluid-permeable support has protrusions and depressions with predetermined shapes in contact with the nonwoven fabric which has the high-stretch regions and the low-stretch regions, and a fluid permeability of the protrusions is lower than a fluid permeability of the depressions.

2. The method according to claim 1, wherein the non-homogeneous stretching is carried out by passing the nonwoven fabric in a machine direction through a gap between a pair of gear rolls with rotational axes that are perpendicular to the machine direction, and rotating the gear rolls while a plurality of teeth situated on peripheral surfaces of the gear rolls are mutually engaged.

3. The method according to claim 2, wherein the plurality of teeth is situated around the peripheral surfaces and along the rotational axes, and the high-stretch regions and low-stretch regions are formed to be parallel to the machine direction, and alternately arranged in a cross direction which is perpendicular to the machine direction.

4. The method according to claim 1, wherein the support is a conveyor net, a paper-making web or a punching plate.

5. The method according to claim 1, wherein the protrusions and depressions are parallel to a cross direction which is perpendicular to a machine direction, in which the nonwoven fabric has been non-homogeneously stretched, and are situated in an alternating fashion in the machine direction.

6. The method according to claim 1, wherein the fluid is selected from the group consisting of air, water vapor and water.

7. The method according to claim 1, wherein the nonwoven fabric is selected from the group consisting of air-through nonwoven fabrics, spunbond nonwoven fabrics, point bond nonwoven fabrics and elastic nonwoven fabrics.

8. The method according to claim 1, wherein the nonwoven fabric having the at least one projection and the at least one recess has air permeability in the thickness direction that is at least 3 times the air permeability in the thickness direction of the nonwoven fabric before being subjected to the non-homogeneous stretching.

9. The method according to claim 1, wherein the nonwoven fabric having the at least one projection and the at least one recess has air permeability in the planar direction of at least 5 $m^3/m^2/min$.

10. The method according to claim 1, wherein the nonwoven fabric having the at least one projection and the at least one recess has a maximum point elongation of 80% or greater in a cross direction which is perpendicular to a machine direction in which the nonwoven fabric has been non-homogeneously stretched.

11. The method according to claim 1, wherein the protrusions and depressions with the predetermined shapes are in contact with a first side of the nonwoven fabric which has the high-stretch regions and the low-stretch regions, and the fluid is sprayed from the fluid nozzle onto a second side of the nonwoven fabric placed on the fluid-permeable support, the second side opposite to the first side in a thickness direction of the nonwoven fabric.

12. A method of processing a nonwoven fabric, said method comprising:

non-homogeneous stretching a nonwoven fabric so as to form high-stretch regions and low-stretch regions in the nonwoven fabric, and forming at least one projection and at least one recess by placing the nonwoven fabric with the high-stretch regions and the low-stretch regions on a fluid-permeable support, and spraying a fluid from a fluid nozzle onto the nonwoven fabric with the high-stretch regions and the low-stretch regions for treatment, wherein the fluid-permeable support has protrusions and depressions with predetermined shapes in contact with the nonwoven fabric which has the high-stretch regions and the low-stretch regions, and a fluid permeability of the protrusions is lower than a fluid permeability of the depressions.

* * * * *